United States Patent [19]

Wagoner

[11] Patent Number: 4,950,976

[45] Date of Patent: Aug. 21, 1990

[54] CURRENT VARIATION REDUCTION FOR MOSFET CURRENT SOURCES

[75] Inventor: Robert G. Wagoner, Troy, Ohio

[73] Assignee: Westinghouse Electric Corp., Pittsburgh, Pa.

[21] Appl. No.: 414,862

[22] Filed: Sep. 29, 1989

[51] Int. Cl.[5] ..... G05F 3/26

[52] U.S. Cl. ..... 323/312; 307/584; 323/315; 323/316

[58] Field of Search ..... 323/315, 316, 317, 312, 323/311; 307/571, 572, 575, 577, 578, 584; 380/285

[56] References Cited

U.S. PATENT DOCUMENTS 4,004,164 1/1977 Cranford et al. ..... 323/315
4,327,321 4/1982 Suzuki et al. ..... 323/315
4,879,524 11/1989 Bell ..... 330/288

FOREIGN PATENT DOCUMENTS 50208 3/1988 Japan ..... 307/572
180213 7/1988 Japan ..... 307/572

*Primary Examiner*—William H. Beha, Jr.
*Attorney, Agent, or Firm*—R. P. Lenart

[57] ABSTRACT

A current variation reduction circuit for metal oxide semiconductor field effect transistors, which are controlled by the application of a drive voltage between the gate and drain terminals, includes a circuit for applying a compensation current to the gate terminal. The compensation current is of substantially equivalent magnitude and opposite polarity to current in the source to gate capacitance of the MOSFET in response to a change in the source to drain voltage of the MOSFET.

8 Claims, 3 Drawing Sheets

CURRENT VARIATION REDUCTION FOR MOSFET CURRENT SOURCES

BACKGROUND OF THE INVENTION

This invention relates to drive circuits for metal oxide semiconductor field effect transistors (MOSFET) and, more particularly, to such circuits in which the MOSFET acts as a current source.

Remote power controllers are used to control loads in power distribution systems, such as those found on aircraft. In some applications, it is desirable to limit the current provided by the power controller to a specific level in the case of an overload. A remote power controller which uses a MOSFET power circuit for current limiting is disclosed in my commonly assigned, copending patent application Ser. No. 07/290,661, filed Dec. 27, 1988, now U.S. Pat. No. 4,914,542, and entitled 'Current Limited Remote Power Controller'.

When a MOSFET is used as a current source, if the voltage across the MOSFET changes rapidly, then the current will also change because of the gate to source capacitance within the MOSFET. In a typical MOSFET current source circuit, the gate of the MOSFET appears as a capacitor to the drive circuit. Internal capacitance exists between the gate and both the drain and the source. When the source to drain voltage of the circuit changes, the gate to drain voltage also changes because of the internal capacitor divider in the MOSFET. This changes the level of current through the MOSFET. This abnormal current condition will remain for a time determined by the time constant of the drive circuit resistance and the gate capacitance.

A number of previous solutions to this undesirable current variation exists. Placing a large capacitor from the gate to the drain or placing an inductor in series with the drain or both, will reduce this effect. However, these solutions also slow down the switching speed of the MOSFET. Another technique for reducing this effect is to keep the output resistance of the drive circuit low. However, this results in a relatively complex drive circuit.

It is therefore desirable to devise a MOSFET drive circuit which is capable of reducing the change in output current in response to a voltage change across the MOSFET without reducing the switching speed of the MOSFET and without using complex, low impedance drive circuitry.

SUMMARY OF THE INVENTION

This invention reduces the change in current of a MOSFET when the voltage across the MOSFET changes and the MOSFET is used to limit current to a specific level, by effectively canceling out the gate to source capacitance under transient conditions. A MOSFET circuit constructed in accordance with the present invention includes a MOSFET having a source terminal, a drain terminal and a gate terminal. A drive circuit is provided for applying a drive voltage between the gate and drain terminals to control the current in an external circuit which may be connected to the source and drain terminals. A current variation reduction circuit is provided to apply a compensation current to the gate terminal, wherein the compensation current is of substantially equivalent magnitude and opposite polarity to current flow through the source to gate capacitance within the MOSFET, in response to a change in voltage between the source and drain terminals.

In the preferred embodiment of this invention, the current variation reduction circuit includes a pair of current mirror circuits electrically connected to each other through two circuit branches. One of the circuit branches is connected to the gate terminal while the other circuit branch includes a resistor. Capacitors are connected from opposite ends of the resistor to the source terminal of the MOSFET. The sum of the capacitance of these capacitors is substantially equivalent to the source to gate capacitance within the MOSFET.

This invention also encompasses the current variation reduction method practiced by the above circuit. By effectively canceling out the gate to source capacitance of the MOSFET under transient conditions, this invention not only reduces the current variation caused by voltage changes across the MOSFET, but also increases the MOSFET switching speed.

BRIEF DESCRIPTION OF THE DRAWINGS

The invention will become more readily apparent from the following description of the preferred embodiments thereof, shown by way of example only, in the accompanying drawings wherein.

DESCRIPTION OF THE PREFERRED EMBODIMENTS

Figure 1:
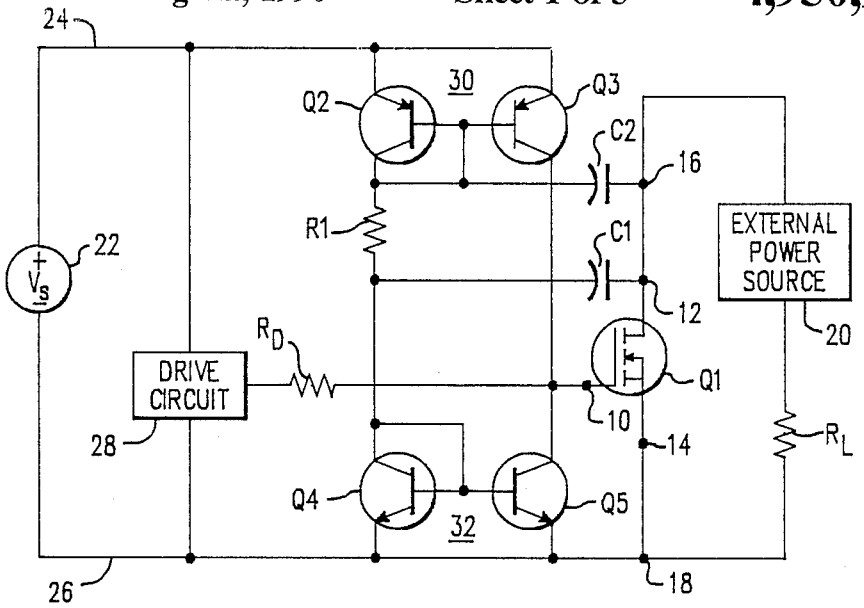
FIG. 1 is a schematic diagram of the preferred embodiment of the present invention.

Referring to the drawings, FIG. 1 is a schematic diagram of a preferred embodiment of the present invention. A MOSFET Q1 having gate, source, and drain terminals 10, 12 and 14 respectively, is connected by way of terminals 16 and 18 to an external power source 20 and a load, symbolically represented by resistor $R_L$. A control voltage source 22 provides a DC voltage on lines 24 and 26. A drive circuit 28 receives this control voltage and produces a gate voltage on the gate of Q1, thereby turning it on. Resistor $R_D$ represents the internal resistance of the drive circuit 28. A current variation reduction circuit comprising current mirror circuits 30 and 32, resistor R1 and capacitors C1 and C2 is provided to reduce the current variation in the MOSFET when the source to drain voltage of the MOSFET, changes as a result of changes in the voltage applied by the external power source 20. The first current mirror circuit comprising transistors Q2 and Q3 is connected as shown such that the collector current of transistor Q3 is equal to the collector current of transistor Q2. The second current mirror circuit includes transistors Q4 and Q5 and is connected as shown such that the collector current of transistor Q5 is equal to the collector current of transistor Q4. The resistance value of resistor R1 is selected to maintain a nominal current to keep transistors Q2, Q3, Q4 and Q5 in the conducting state. This current is approximately equal to $(V_s 1.5)/R1$. The same current flows through transistors Q3 and Q5 and does not affect the operation of the MOSFET on a steady state basis.

Capacitors C1 and C2 to be substantially equal to one-half of the gate to source capacitance of the MOSFET. When the source to drain voltage of the MOSFET changes in response to a change in the voltage applied by the external power source, the current that flows in the gate to source capacitance is opposed by the currents in transistors Q3 and Q5. This reduces the change in gate voltage, and thereby reduces the change in the MOSFET source to drain current. This occurs because the current which flows in the capacitors C1 and C2 is inverted by the current mirror circuits, thereby applying the opposite current to the gate of the MOSFET. This effectively cancels out the gate to source capacitance of the MOSFET and increases its switching speed.

Figure 2:
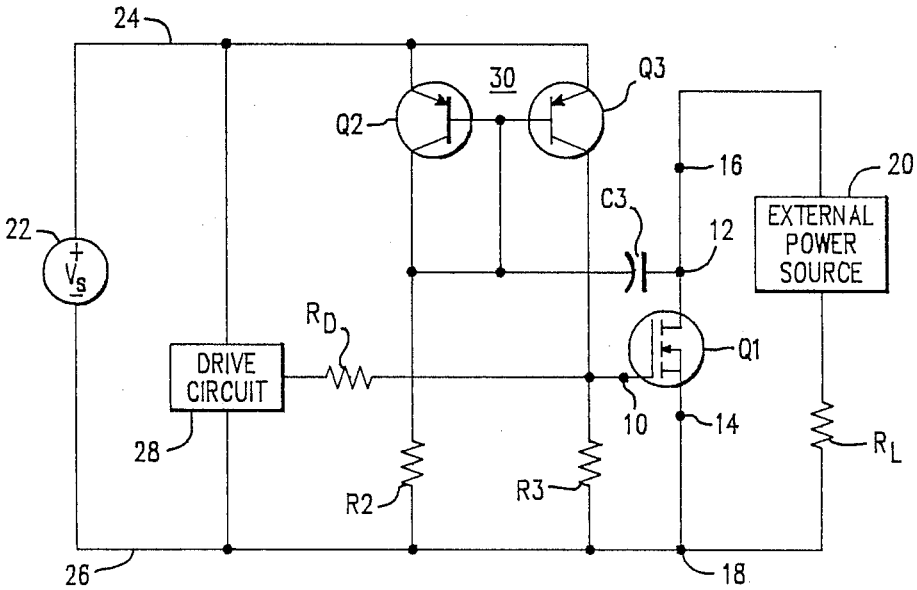
FIGS. 2 and 3 are schematic diagrams of alternative embodiments of the invention.
Figure 3:
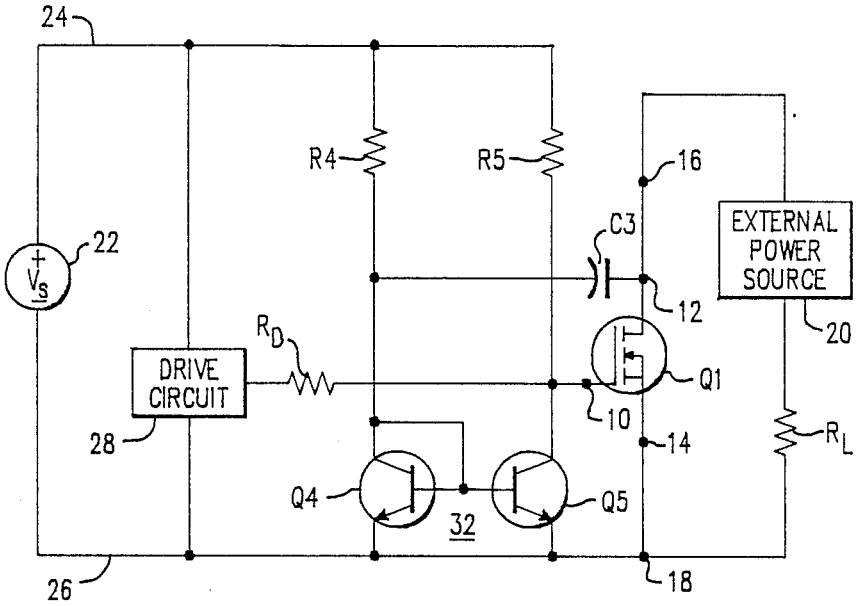

Two alternative embodiments of the present invention are illustrated in the schematic diagrams of FIGS. 2 and 3. For clarity, identical designations have been used for corresponding parts throughout the figures. In FIG. 2, the current mirror 32 of FIG. 1 has been replaced by two resistors R2 and R3. In FIG. 3, the current mirror 30 of FIG. 1 has been replaced by resistors R4 and R5. In both FIGS. 2 and 3, capacitors C1 and C2 of FIG. 1 have been replaced by capacitor C3. The circuits of FIGS. 2 and 3 have the advantages of simplicity and reduced parts count but suffer from the disadvantage that the maximum current available is limited in one direction by the resistor connected to the gate, which limits the maximum slew rate of the output voltage that can be corrected. A second disadvantage is that the two circuits shown are more susceptible to power supply noise.

Figure 4:
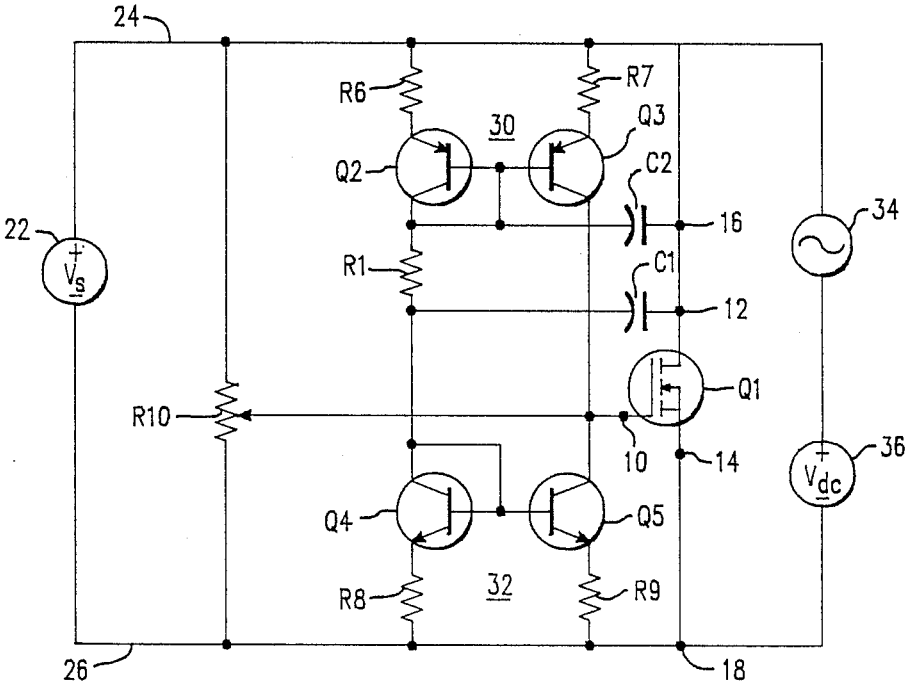
FIGS. 4 and 5 are schematic diagrams of circuits constructed in accordance with the invention to demonstrate its operation.
Figure 5:
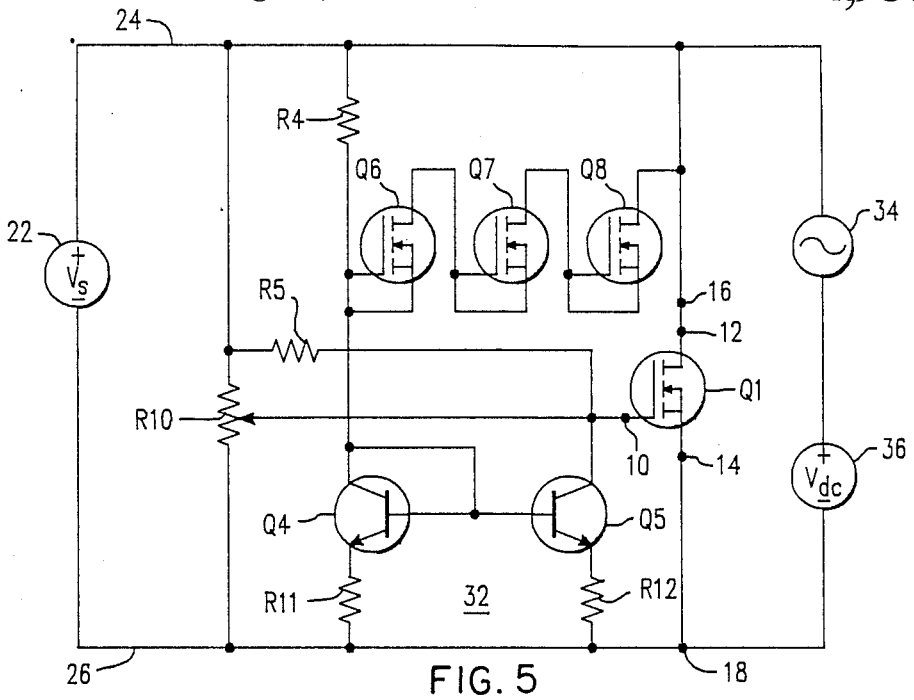

The circuits of FIGS. 4 and 5 were constructed to demonstrate the operation of the present invention. The circuit of FIG. 4 is similar to the circuit of FIG. 1 except for the addition of emitter resistors R6, R7, R8, R9 and the use of potentiometer R10 to replace the drive circuit 28. The external power source is simulated by the series connection of an AC source 34 and a DC source 36. FIG. 5 is similar to the circuit of FIG. 3 except for the addition of emitter resistors R11 and R12, the substitution of potentiometer R13 for the drive circuit and the substitution of three MOSFETS Q6, Q7 and Q8 for the capacitor C3.

The gate to source capacitance of a MOSFET varies with applied voltage, so by using fixed feedback capacitors, complete cancellation of the ripple current will only occur at one particular applied voltage. In addition, the gate to source capacitance of a MOSFET also varies with temperature, therefore temperature compensation is desirable. Furthermore, if the sum of the feedback capacitors is greater than the gate to source capacitance of the output MOSFET, then the circuit will become unstable and oscillate due to positive feedback. These problems are eliminated through the use of MOSFETs Q6, Q7 and Q8, using the gate to souce terminals as a capacitor, with the gates tied to the drains. Then the feedback capacitance varies with the capacitance of the output MOSFET, and the elimination of ripple current can be achieved at all applied voltages. By placing resistors in series with the emitters of the transistors in the current mirror circuits or by using transistors with different die sizes or betas, the gain of these circuits can be varied to eliminate oscillation problems and to use smaller MOSFETs for the feedback capacitors.

Figure 6:
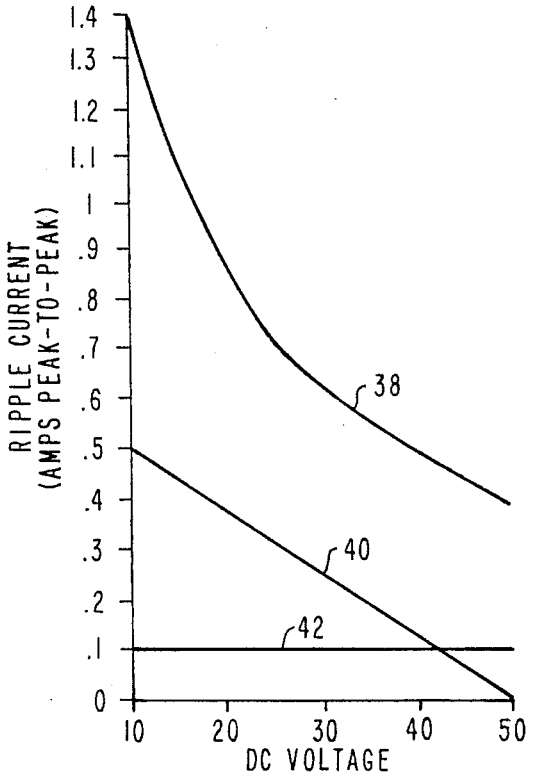
FIG. 6 is a plot of ripple current versus DC voltage, which illustrates the current variation reductions achieved by the circuits of FIGS. 4 and 5.

FIG. 6 shows a series of curves representing the relationship between the peak-to-peak ripple current for three MOSFET circuits in which a 5 volt AC peak-to-peak 20 kHz sine wave was superimposed on an applied DC voltage and the gate voltage to the MOSFET was adjusted with a variable resistor to get one amp of DC current flowing in the MOSFET. Curve 38 represents the ripple current in a basic circuit similar to the circuit of FIGS. 4 and 5 wit the current variation reduction circuit removed. The ripple current of the basic circuit, which was not constructed in accordance with this invention, varied from 0.4 to 1.4 amps. The ripple current of the circuit of FIG. 4 is illustrated by Curve 40. That circuit used fixed feedback capacitors and the ripple current varied from 0 to 0.5 amps. The ripple current for the circuit of FIG. 5 is illustrated by Curve 42. That circuit used MOSFETs as the feedback capacitor and the ripple current remain constant at about 0.1 amps.

Although the present invention has been described in terms of what are at present believed to be its preferred embodiments, it will be apparent to those skilled in the art that various changes may be made without departing from the scope of the invention. It is therefore intended that the appended claims cover such changes.

What is claimed is:

1. A metal oxide semiconductor field effect transistor (MOSFET) current source circuit comprising:

a metal oxide semiconductor field effect transistor having a source terminal, a drain terminal and a gate terminal;

means for connecting said source and drain terminals to an external circuit;

means for applying a drive voltage between said gate and drain terminals; and means for applying a compensation current to said gate terminal, said compensation current being of substantially equivalent magnitude and opposite polarity to current flow through a source to gate capacitance within said metal oxide semiconductor field effect transistor in response to a change in voltage between said source and drain terminals, wherein said means for applying a compensation current includes first and second current mirror circuits electrically connected to each other by first and second circuit branches; said first circuit branch including a connection point electrically connected to said gate terminal; said second circuit branch including a first resistor; first and second capacitors; said first capacitor being electrically connected between a first end of said first resistor and said source terminal; and said second capacitor being electrically connected between a second end of said resistor and said source terminal.

2. A metal oxide semiconductor field effect transistor (MOSFET) current source circuit as recited in claim 1, wherein:

the sum of the capacitance of said first and second capacitors is substantially equal to the source to gate capacitance of said metal oxide semiconductor field effect transistor.

3. A metal oxide semiconductor field effect transistor (MOSFET) current source circuit as recited in claim 1, wherein said first and second capacitors each comprise:

a second metal oxide semiconductor field effect transistor having a gate terminal, a source terminal and a drain terminal, said gate and drain terminals of said second metal oxide semiconductor field effect transistor being electrically connected together.

4. A metal oxide semiconductor field effect transistor (MOSFET) current source circuit as recited in claim 1, wherein each of said first and second current mirror circuits comprises:

a first bipolar transistor having an emitter, a base and a collector, said collector being connected to said first circuit branch;

a second bipolar transistor having an emitter, a base and a collector, said collector being connected to said second circuit branch;

said emitters of said first and second transistors being electrically connected together; and said base and said collector of said second transistor being electrically connected together.

5. A metal oxide semiconductor field effect transistor (MOSFET) current source circuit comprising:

a metal oxide semiconductor field effect transistor having a source terminal, a drain terminal and a gate terminal;

means for connecting said source and drain terminals to an external circuit;

means for applying a drive voltage between said gate and drain terminals; and means for applying a compensation current to said gate terminal, said compensation current being of substantially equivalent magnitude and opposite polarity to current flow through a source to gate capacitance within said metal oxide semiconductor field effect transistor in response to a change in voltage between said source and drain terminals, wherein said means for applying a compensation current includes a first current mirror circuit electrically connected to first and second circuit branches; said first circuit branch including a first resistor and a connection point between said first resistor and said first current mirror circuit, said connection point being electrically connected to said gate terminal; said second circuit branch including a second resistor; a first capacitor; and said first capacitor being electrically connected between said source terminal and a junction point in said second circuit branch between said current mirror circuit and said second resistor.

6. A metal oxide semiconductor field effect transistor (MOSFET) current source circuit as recited in claim 5, wherein:

the capacitance of said first capacitor is substantially equal to the source to gate capacitor of said metal oxide semiconductor field effect transistor.

7. A metal oxide semiconductor field effect transistor (MOSFET) current source circuit as recited in claim 5, wherein:

said current mirror circuit is electrically connected to said drain terminal; and said first and second resistors are electrically connected to a first conductor.

8. A metal oxide semiconductor field effect transistor (MOSFET) current source circuit as recited in claim 5, wherein:

said current mirror circuit is electrically connected to a first conductor; and said first and second resistors are electrically connected to said drain terminal.

* * * * *